US009695705B2

(12) United States Patent
Zheng et al.

(10) Patent No.: US 9,695,705 B2
(45) Date of Patent: Jul. 4, 2017

(54) SYSTEMS AND METHODS FOR CONTROLLING ROTOR TO STATOR CLEARANCES IN A STEAM TURBINE

(71) Applicant: GENERAL ELECTRIC COMPANY, Schenectady, NY (US)

(72) Inventors: Xiaoqing Zheng, Schenectady, NY (US); Edward Arthur Dewhurst, Schenectady, NY (US); Edward J. Cooper, Schenectady, NY (US); Hemanth Kumar, Bangalore (IN)

(73) Assignee: General Electric Company, Schenectady, NY (US)

( * ) Notice: Subject to any disclaimer, the term of this patent is extended or adjusted under 35 U.S.C. 154(b) by 394 days.

(21) Appl. No.: 14/526,827

(22) Filed: Oct. 29, 2014

(65) Prior Publication Data

US 2016/0123173 A1 May 5, 2016

(51) Int. Cl.
*F01D 11/24* (2006.01)
*F01D 25/14* (2006.01)

(52) U.S. Cl.
CPC ..... *F01D 11/24* (2013.01); *F01D 25/14* (2013.01)

(58) Field of Classification Search
CPC ..... F01D 11/025; F01D 11/14; F01D 11/16; F01D 11/18; F01D 11/20; F01D 11/24; F01D 25/14; F01D 25/24
USPC ..... 415/1, 126
See application file for complete search history.

(56) References Cited

U.S. PATENT DOCUMENTS

| | | | | |
|---|---|---|---|---|
| 4,076,452 | A * | 2/1978 | Hartmann | F01D 9/065 415/142 |
| 7,237,958 | B2 | 7/2007 | Giberson | |
| 7,434,402 | B2 | 10/2008 | Paprotna | |
| 7,458,770 | B2 | 12/2008 | Russo et al. | |
| 7,686,569 | B2 | 3/2010 | Paprotna et al. | |
| 8,970,228 | B2 * | 3/2015 | Andarawis | G01B 7/14 324/658 |
| 9,039,346 | B2 * | 5/2015 | Muralidharan | F01D 25/14 415/47 |
| 9,341,462 | B2 * | 5/2016 | Szedlacsek | G01B 7/14 |
| 9,376,934 | B2 * | 6/2016 | Cooper | F01D 25/24 |
| 2001/0023581 | A1 | 9/2001 | Ojiro | |
| 2010/0104416 | A1 | 4/2010 | Willett | |
| 2010/0162722 | A1 | 7/2010 | McQuiggan | |
| 2010/0232942 | A1 | 9/2010 | Bock | |
| 2010/0329837 | A1 | 12/2010 | Cooper et al. | |
| 2011/0142605 | A1 | 6/2011 | Koza et al. | |
| 2012/0195750 | A1 * | 8/2012 | Navjot | F01D 25/28 415/213.1 |

(Continued)

*Primary Examiner* — Kenneth Bomberg
*Assistant Examiner* — Hoon Choi
(74) *Attorney, Agent, or Firm* — Nixon & Vanderhye P.C.

(57) ABSTRACT

Systems and methods for controlling a clearance between a rotor and a stator of a steam turbine during transient operations rely upon heating or cooling a shell support structure of the steam turbine that supports the stator of the steam turbine. Selectively heating or cooling the shell support structure makes it possible for thermal growth/contraction rates and magnitudes of the shell support structure to better match the thermal growth/contraction rates and magnitudes of a bearing support structure of the steam turbine during transient operations. As a result, the clearance between the rotor and the stator of the steam turbine can be maintained.

19 Claims, 7 Drawing Sheets

(56) References Cited

U.S. PATENT DOCUMENTS

2015/0078887 A1* 3/2015 Ueda ..... F01D 25/162
415/116

* cited by examiner

SYSTEMS AND METHODS FOR CONTROLLING ROTOR TO STATOR CLEARANCES IN A STEAM TURBINE

BACKGROUND OF THE INVENTION

Steam turbines include a shell that functions to contain the high pressure, high temperature steam and to support the nozzles and casings that direct steam in the most efficient manner possible through rotating airfoils to produce maximum torque on the shaft. The shell includes support arms that extend outward from the shell. Shell arms rest on a support structure that is integral to a structure that also provides support for the turbine rotor, and which serves to house other turbine related components and instrumentation. This structure is often referred to as a "standard". The elements of the stator portion of the steam turbine are coupled to the shell, thus, the stator portion of the steam turbine is supported by the shell arm support structure.

The rotor of the steam turbine is typically supported by bearings. The bearings are typically mounted within a bearing housing that is supported by a bearing support structure. The bearing support structure can be a part of the "standard" mentioned above. The bearing support structure, while it may be integral with the standard, is not integral with the shell arm support structure. The shell arm support structures and the bearing support structures are exposed to different environmental conditions during various stages of operation of the steam turbine. During transient operations, including but not necessarily limited to startup, load changes, shutdown, and cool downs while on turning gear, different portions of the steam turbine and the supporting elements experience changes in temperature. These changes in temperature may occur at different rates within the different parts of the steam turbine and its support structure, which leads to differential thermal growth of the steam turbine elements, and the support elements.

During startup operations, the bearings and the bearing support structure which supports the bearings and the rotor of the steam turbine tend to increase in temperature more quickly than the shell arm support structure. In part, this occurs because the bearings supporting the rotor rapidly heat up during startup because they are being driven by the changing oil temperature which they are in constant contact with, and the heat generated in the bearings is transferred to the bearing support structure. In contrast, the shell and the shell arm support structure, which are not in constant contact with the oil, tend to warm up more slowly.

Similarly, the bearings typically cool more rapidly upon shutdown because oil supply temperature is lowered as the steam turbine moves from full speed operation to operation at turning gear speeds. In contrast, the support structure beneath the shell arms generally cools very slowly because its temperature is driven more by shell temperature and conduction of that heat from the shell arms into the structure. Shell temperatures decay very slowly. And this can cause the bearing support structure to cool more quickly than the shell arm support structure upon shutdown.

When there are differences in the rate at which the temperature of the bearing support structure increases or decreases, as compared to the rate at which the temperature of the shell arm support structure increases or decreases, the temperature differences can lead to differences in the rate or amount of thermal expansion and contraction of these two elements. And differences in the rate or amount of thermal expansion or contraction as between the bearing support structure and the shell arm support structure can cause changes in the amount of radial clearance available between rotating and stationary parts.

BRIEF DESCRIPTION OF THE INVENTION

In one aspect, the invention may be embodied in a system for controlling a clearance between a rotor and a stator of a steam turbine during transient operations, the system including a shell support structure configured to support a shell of a steam turbine, the shell support structure having a main body including a base and an upper support that is configured to support at least one shell arm of a shell of a steam turbine and an interior passageway that passes through an interior of the main body between an inlet and an outlet, wherein the interior passageway is configured to conduct a flow of a heating or cooling medium. The system also includes a condensate supply line that is coupled to the inlet of the interior passageway of the shell support structure, the condensate supply line supplying condensate that has been created from steam that has passed through a steam turbine that is supported by the shell support structure. The system further includes a control valve that selectively varies a low rate of the condensate through the interior passageway of the shell support structure.

In another aspect, the invention may be embodied in a method of controlling a clearance between a rotor and a stator of a steam turbine during transient operations. The method determining that a transient operation has begun, and selectively supplying a flow of a heating or a cooling medium to an interior passageway of a shell support structure of the steam turbine to cause controlled thermal growth or contraction of the shell support structure, thereby controlling a clearance between a rotor and a stator of the steam turbine In another aspect, the invention may be embodied in a system for controlling a clearance between a rotor and a stator of a steam turbine during transient operations that includes means for determining that transient operations have begun, and means for selectively supplying a flow of a heating or a cooling medium to an interior passageway of a shell support structure of the steam turbine to cause controlled thermal growth or contraction of the shell support structure, thereby controlling a clearance between a rotor and a stator of the steam turbine.

DETAILED DESCRIPTION OF PREFERRED EMBODIMENTS

Figure 2:
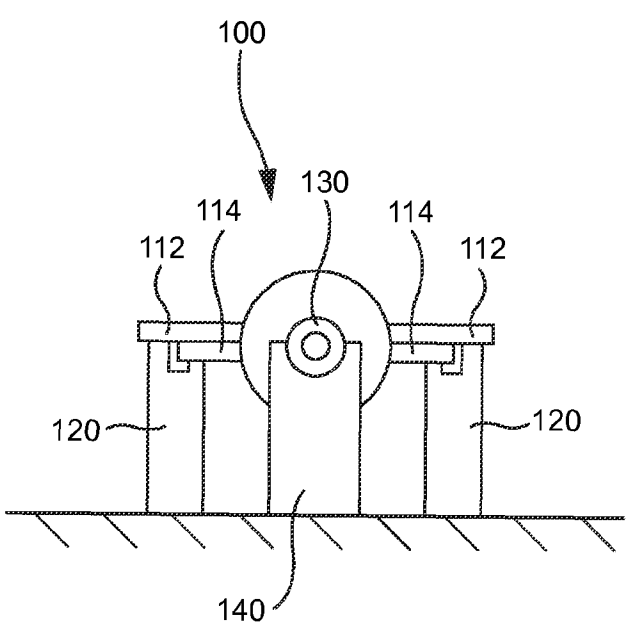
FIG. 2 is an end view of a steam turbine mounted on a support structure.
Figure 1:
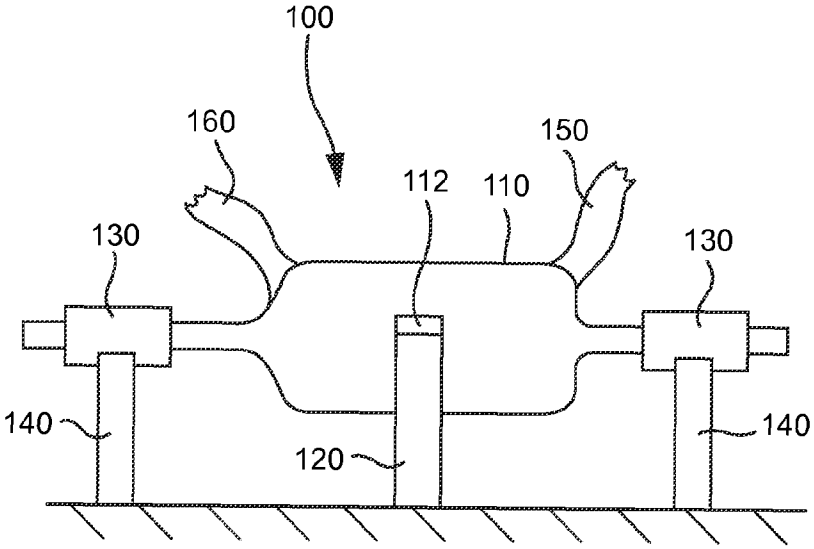
FIG. 1 is a side view of a steam turbine mounted on a support structure.

FIGS. 1 and 2 provide highly simplified diagrams of how a steam turbine 100 is mounted within a facility. As shown in these Figures, a shell 110 that encases the steam turbine includes upper shell arms 112 and/or lower shell arms 114. The shell arms are mounted on shell arm support structures 120 positioned on either side of the shell 110. In the embodiment illustrated in FIGS. 1 and 2, a single upper shell arm 112 and a single lower shell arm 114 extend from each side of the shell 110. However, in alternate embodiments, multiple pairs of upper and lower shell arms 112/114 may be provided on each side of the shell 110. Each pair of upper and lower shell arms 112/114 could be supported by the same shell arm support structure, or they could be supported by separate shell arm support structures 120. The elements of the stator of the steam turbine would be mounted to the shell 110. Thus, the shell arm support structures 120 support the stator of the steam turbine.

FIGS. 1 and 2 also illustrate that rotor bearings 130 support the rotor of the steam turbine. As also illustrated, the bearings 130 are supported by bearing support structures 140. Thus, the rotor of the steam turbine is supported by the bearing support structures 140. Although the embodiment illustrated in FIGS. 1 and 2 includes two bearings 130 supported by two corresponding bearing support structures 140, in alternate embodiments more than two bearings and corresponding bearing support structures could be provided.

A steam supply line 150 provides high pressure steam to drive the steam turbine. A low pressure steam line 160 carries away low pressure steam, or condensate, after the high pressure steam has passed through the steam turbine.

In any given embodiment, the steam turbine could be a high pressure steam turbine, an intermediate pressure steam turbine or a low pressure steam turbine. In some embodiments, both low pressure and intermediate pressure steam turbines may be located within a single shell structure. Likewise, both an intermediate and a high pressure steam turbine may be located within a single shell structure. Thus, the depiction provided in FIGS. 1 and 2 should in no way be considered limiting. In the foregoing and following descriptions, any reference to a steam turbine should be considered to apply to a low pressure steam turbine, an intermediate pressure steam turbine, a high pressure steam turbine, or any combination thereof.

As explained above, during startup operations the elements of the steam turbine and the shell and bearing support structures would all gradually increase in temperature. However, as also noted above, it is common for the bearings 130 of the steam turbine to rapidly increase in temperature. And as a result, the temperature of the bearing support structures 140 tends to rapidly increase during startup. In contrast, the shell 110 of the steam turbine, which is coupled to the stator of the steam turbine, tends to increase in temperature more slowly than the bearings 130. As a result, the temperature of the shell support structures 120 tends to increase more slowly than the temperature of the bearing support structures 140.

Increases in the temperatures of the bearing support structures 140 and the shell support structures 120 cause corresponding thermal expansion of these elements. But because the temperatures of the elements change at varying rates, the amount of thermal expansion that occurs also occurs at different rates.

Figure 3:
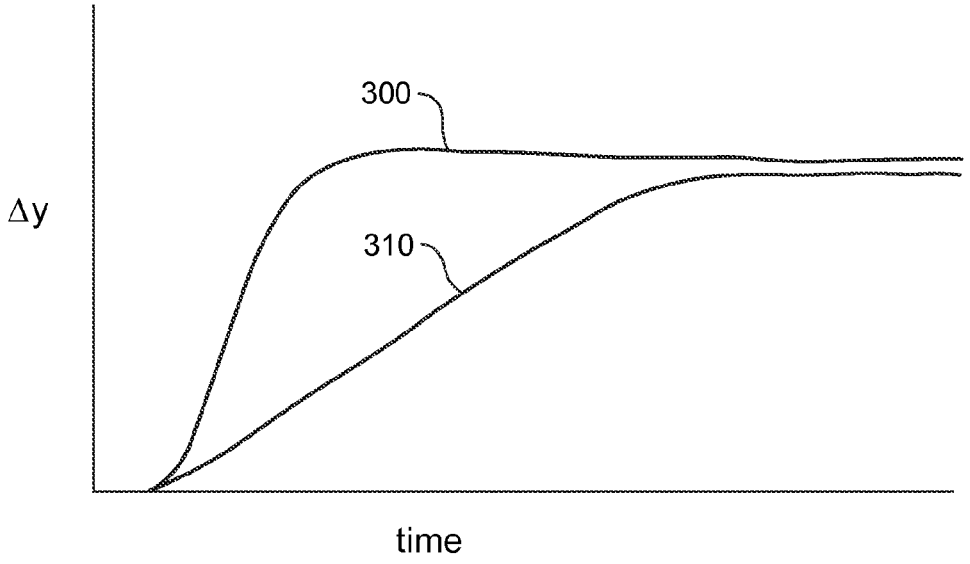
FIG. 3 is a diagram illustrating how the thermal growth of a shell support structure and a bearing support structure vary during a transient operation.

FIG. 3 depicts the degree or amount of thermal expansion experienced by the bearing support structures 140 and the shell support structures 120 of a steam turbine during a startup operation. The line identified with reference number 300 represents the amount of thermal expansion of the bearing support structures 140 that occurs during startup. The line identified with reference number 310 represents the amount of thermal expansion of the shell support structures that occurs during startup. As reflected in FIG. 3, after a certain period of time, both the bearing support structures 140 and the shell support structures expand approximately the same amount. But during the startup operation, there is a period of time when the amount of thermal expansion experienced by the bearing support structures 140 is significantly greater than the amount of thermal expansion experienced by the shell support structures 120.

The differences in the amounts of thermal expansion between the bearing support structures 140 and the shell support structures 120 can cause radial clearance problems for the steam turbine. Essentially, during the startup operation the rotor, which rests on the bearing support structures 140, will be lifted upward more rapidly than the stator, which is supported on the shell support structures 120. Thus, for a certain period of time, the centerline of the rotor is misaligned with the centerline of the stator.

One way to accommodate this problem is to ensure that all radial clearances between the elements of the rotor and the elements of the stator are large enough to ensure that even during the period of time when the thermal expansion mismatch between the bearing support structures and the shell support structures is greatest, elements of rotor will not rub against corresponding elements of the stator. Unfortunately, building such clearances into the steam turbine necessarily requires a sacrifice of some performance. Also, over time, as wear occurs, the clearances can decrease to the point where elements of the rotor begin to rub against elements of the stator during startup operations.

Figure 4:
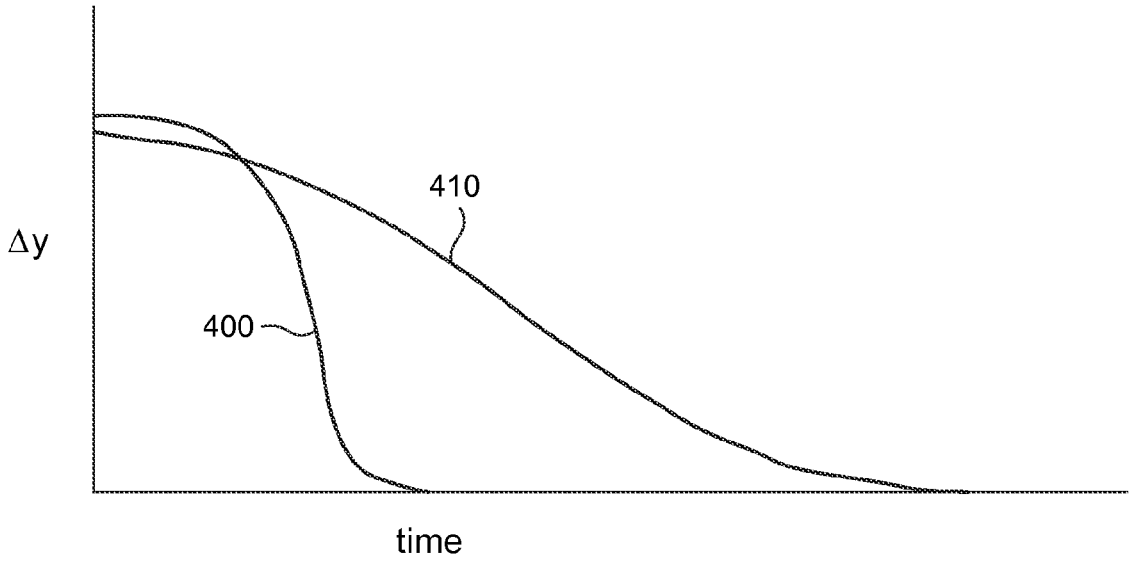
FIG. 4 is a diagram illustrating how the thermal contraction of a shell support structure and a bearing support structure vary over time during a transient operation.

The same basic issues exist during shutdown/cool down operations. FIG. 4 illustrates the amount of thermal contraction that occurs for the bearing support structures 140 and the shell support structures 120 of a steam turbine during a shutdown/cool down operation. The line identified with reference number 410 represents the amount of thermal contraction experienced by the shell support structures 120 during shutdown/cool down. The line identified with reference number 400 represents the amount of thermal contraction experienced by the bearing support structures 140 during shutdown/cool down. As illustrated, there is a period of time when the thermal contraction of the bearing support structures 140 is much greater than the thermal contraction of the shell support structures 120. This basically means that the rotor is lowered more quickly than the stator during shutdown, which causes all the same types of radial clearance issues discussed above in connection with startup operations.

Figure 5:
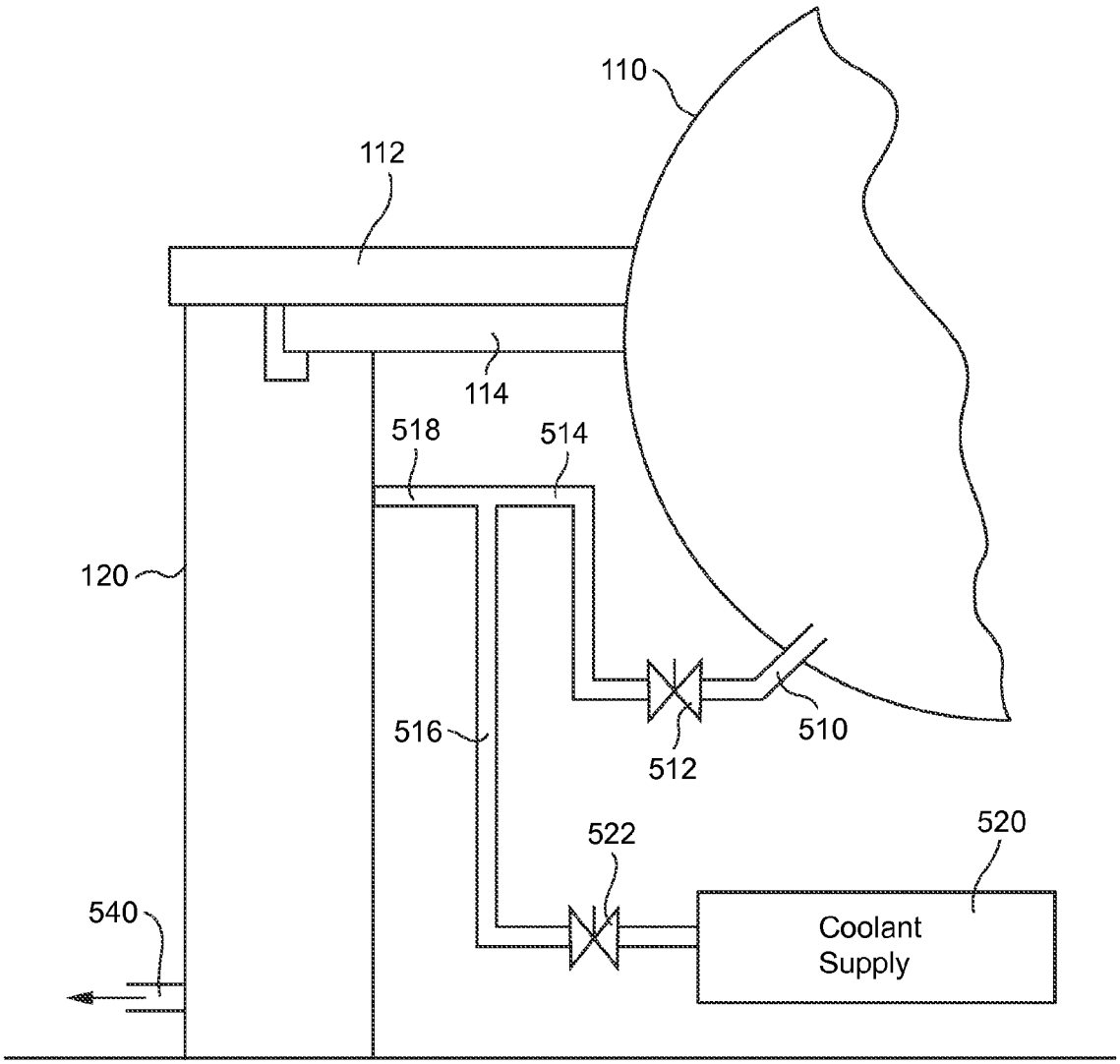
FIG. 5 is a diagram illustrating how a supply of steam or condensate and a coolant is coupled to interior passageways of a shell support structure of a steam turbine.

FIG. 5 depicts a system which can be used to help maintain proper clearances between a rotor and a stator of a steam turbine during transient operations, such as startup and shutdown operations. This system includes elements that are designed to achieve controlled thermal expansion and contraction of the shell support structures 120 during transient periods. The aim is for the amount or rate of thermal expansion experienced by the shell support structures 120 to more closely match the amount or rate of thermal expansion experienced by the bearing support structures 140. As a result, the shell 110 and the stator of the steam turbine is moved upward during startup and downward during shutdown at rates that more closely match that of the bearings and the rotor of the steam turbine, thereby better maintaining radial clearances between the rotor and the stator.

As illustrated in FIG. 5, a steam/condensate supply pipe 510 extends from the shell 110 of the steam turbine. The supply pipe 510 supplies steam and/or condensate. that has a high enough temperature to effectively heat the shell support structures 120 to accomplish controlled thermal expansion of the shell support structures during a startup operation.

The medium that is supplied through the steam/condensate supply pipe 510 could be steam, or it could be condensate, or it could be a mixture of both. Also, in some embodiments, the steam in the steam/condensate supply pipe 510 may be provided from a source or sources other than from within the shell 110 of the turbine. Thus, in some embodiments, the steam/condensate supply pipe 510 may not originate within the shell 110, as depicted in FIG. 5.

The system also includes a heating medium supply pipe 514 that leads to an inlet 518 on the shell support structure 120. A heating medium control valve 512 is provided on the heating medium supply pipe 514 to control a flow rate of the heating medium supplied through the supply pipe 514 to the inlet 518.

Figure 6:
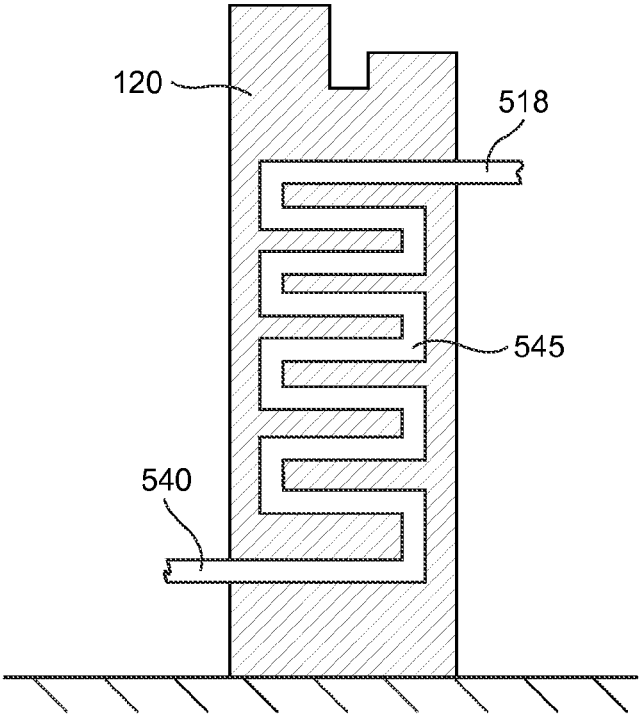
FIG. 6 is a cross-sectional view of a first embodiment of a steam turbine shell support structure that includes an interior passageway capable of conducting a heating and/or cooling medium.
Figure 7:
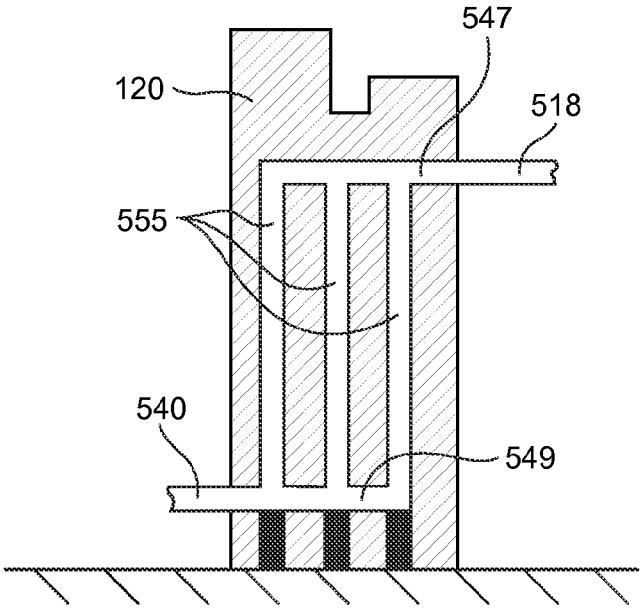
FIG. 7 is a cross-sectional view of a second embodiment of a steam turbine shell support structure that includes interior passageways capable of conducting a heating and/or cooling medium.

FIGS. 6 and 7 are cross-sectional views that illustrate the interior of two alternate embodiments of shell support structures 120. In the embodiment illustrated in FIG. 6, a serpentine interior passageway 545 extends between the inlet 518 and an outlet 540. In the embodiment illustrated in FIG. 7, the inlet 518 is coupled to an inlet manifold 547, and the outlet 540 is coupled to an outlet manifold 549. A plurality of branches 555 extend between the inlet manifold 547 and the outlet manifold 549.

The embodiment illustrated in FIG. 7 may be easier to manufacture, as a series of straight holes could be drilled into the shell support structure 120 to form the inlet manifold 547, the outlet manifold 549 and the branches 555. The branches 555 could be formed by drilling straight holes upward from the bottom of the shell support structure 120, and then plugging the portions of the holes at the bottom of the shell support structure 120 that extend beneath the outlet manifold 549.

Of course, in alternate embodiments, the interior passageway(s) located inside the shell support structures 120 and that extend between the inlet 518 and the outlet 540 could have a variety of other forms.

When a shell support structure 120 as illustrated in FIGS. 6 and 7 is coupled to the other elements illustrated in FIG. 5, it is possible to deliver a flow of a heating medium, in the form of condensed steam, into the interior passageways in the shell support structure 120. The condensate exiting the outlet 540 could be routed back into a steam regeneration circuit to be reused with the steam turbine, or the condensate could be routed to a drain.

A system as illustrated in FIG. 5 provides a simple means of causing the shell support structure 120 to rapidly heat up along with the bearing support structures 140. Thus, the thermal expansion of the shell support structures can be more closely matched to the thermal expansion of the bearing support structures during transient periods when the temperatures of both supports are on the rise. The heating medium control valve 512 is used to control the flow rate of the condensate into the shell support structure 120 to control the rate of thermal expansion of the shell support structure 120.

Although the embodiment illustrated in FIG. 5 shows the heating medium supply line 514 coupled to a steam/condensate supply pipe 510, in alternate embodiments an alternate heating medium from a heating medium supply could be used. If an alternate heating medium is used, the outlet 540 may be coupled back to the heating medium supply, so that the heating medium can be circulated.

FIG. 5 also illustrates that a coolant supply 520 supplies a cooling medium to the inlet 518 of the shell support structure 120 via a cooling medium supply line 516. A cooling medium control valve 522 is operatively coupled to the cooling medium supply line 516 to control the flow of cooling medium supplied to the inlet 518. In some embodiments, the cooling medium could simply be tap water supplied at room temperature. If water is used as the cooling medium, the water exiting the outlet 540 of the shell support structures 120 could simply be routed into a drain.

In alternate embodiments, some other cooling medium could be used. If an alternate cooling medium from a coolant supply is used to cool the shell support structure 120, the cooling medium exiting the outlet 540 may be routed back to the coolant supply so that the cooling medium can be recirculated.

In some embodiments, a mixture of coolant from the coolant supply 520 and condensate from the steam/condensate supply pipe 510 could be introduced into the inlet 518 of the shell support structure 120. The control valves 512, 522 would be selectively opened and closed to selectively vary the mixture that is introduced into the inlet 518. This can provide great control over the temperature and flow rate of the medium that is flowing through the shell support structure 120 to carefully control the thermal expansion of the shell support structure 120.

Temperature sensors may be mounted on the shell arm supports and the bearing supports to help monitor the temperature of those elements.

During shutdown operations, the cooling medium from the coolant supply 520 could be used to cool the shell support structure 120. By selectively varying the flow rate of the cooling medium, using the cooling medium control valve 522, one can control the rate at which the shell support structure undergoes thermal contraction. Thus, rate of thermal contraction of the shell support structure 120 can be matched to the rate of thermal contraction of the bearing support structures 140 so that the clearances between the rotor and the stator are maintained during shutdown operations.

When a shell support structure 120 as illustrated in FIGS. 6 and 7 is coupled to the other elements illustrated in the embodiments in FIG. 5, it is possible to deliver a flow of a heating/cooling medium, into the interior passageways within the shell support structure 120 during all periods of operation, including but not necessarily limited to startup, periods of commercial operation under varying load levels, shutdowns, trips, rolldowns from speed, and periods of cooldown on or off turning gear. In embodiments that include flow control valves 512, 522, selectively varying the opening of the control valves can vary the amount of the heating/cooling medium supplied to the inlet 518 of the shell support structure 120, and thus the rate at which the shell support structure thermally expands/contracts. The rate of thermal expansion/contraction of the shell support structure 120 can then be adjusted to match the rate of thermal expansion/contraction of the bearing support structures 140 during transient operations.

Figure 8:
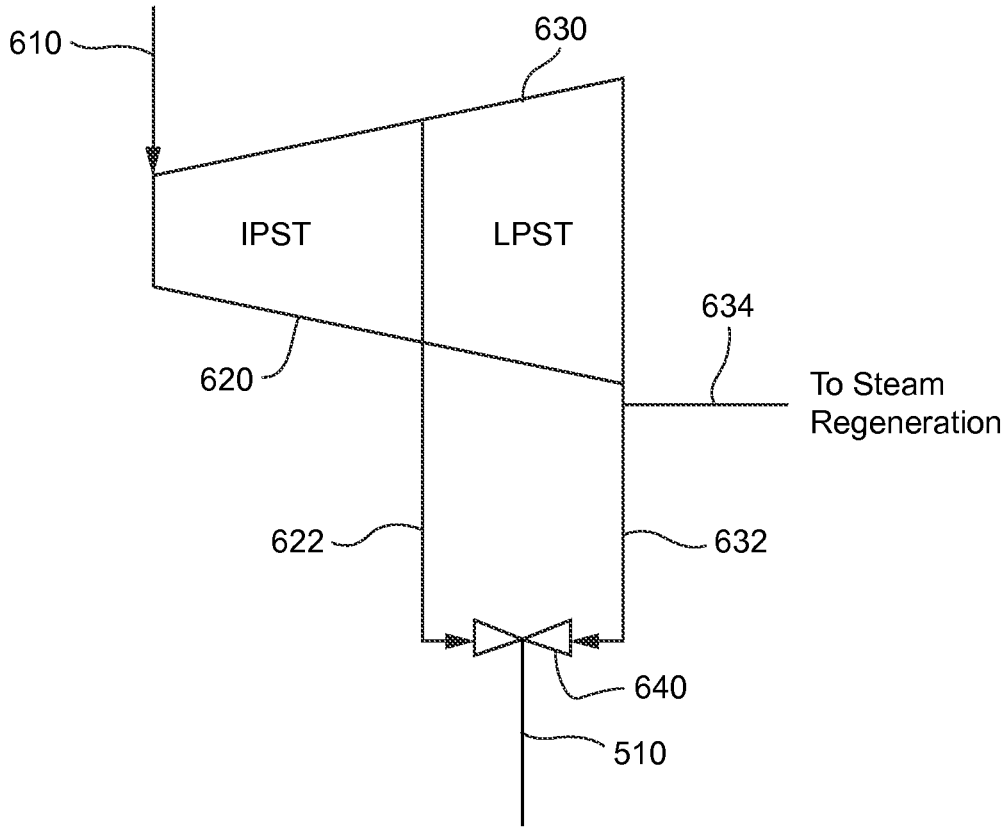
FIG. 8 is a diagram illustrating how steam and/or condensate from two steam turbines can be selectively combined to create a flow of steam and/or condensate that can be used to control the thermal growth/contraction of a shell support structure.

FIG. 8 illustrates that the steam/condensate exiting two or more steam turbines could be combined to create the steam/condensate that is ultimately delivered into the steam/condensate supply pipe 510 in the system illustrated in FIG. 5. FIG. 8 depicts an intermediate pressure steam turbine 620 and a low pressure steam turbine 630. Steam from a steam supply line 610 is delivered into the intermediate pressure steam turbine 620. A portion of the steam exiting the intermediate pressure steam turbine 620 is routed into a first steam/condensate supply line 622, and the remainder of the steam exiting the intermediate pressure steam turbine 620 is routed into the low pressure steam turbine 630. A portion of the steam/condensate leaving the low pressure steam turbine 630 is routed into a regeneration line 634 that carries the steam and/or condensate back to a steam regeneration process. The remainder of the steam and/or condensate leaving the low pressure steam turbine 630 is routed into a second steam/condensate supply line 632.

The first steam/condensate supply line 622 and second steam/condensate supply line 632 are coupled to a control valve 640 that selectively mixes the steam/condensate and delivers the mixture into the steam/condensate supply pipe 510. As discussed above, condensate resulting from the steam/condensate in the steam/condensate supply pipe 510 is then selectively introduced into a shell support structure 120 to control the thermal expansion of the shell support structure 120. The control valve 640 can control the relative amounts of the two different steams/condensates to control the temperature of the steam/condensate in the steam/condensate supply pipe 510. Of course, separate control valves, one in each of lines 622 and 632, could be provided instead of a single control valve 640.

Figure 9:
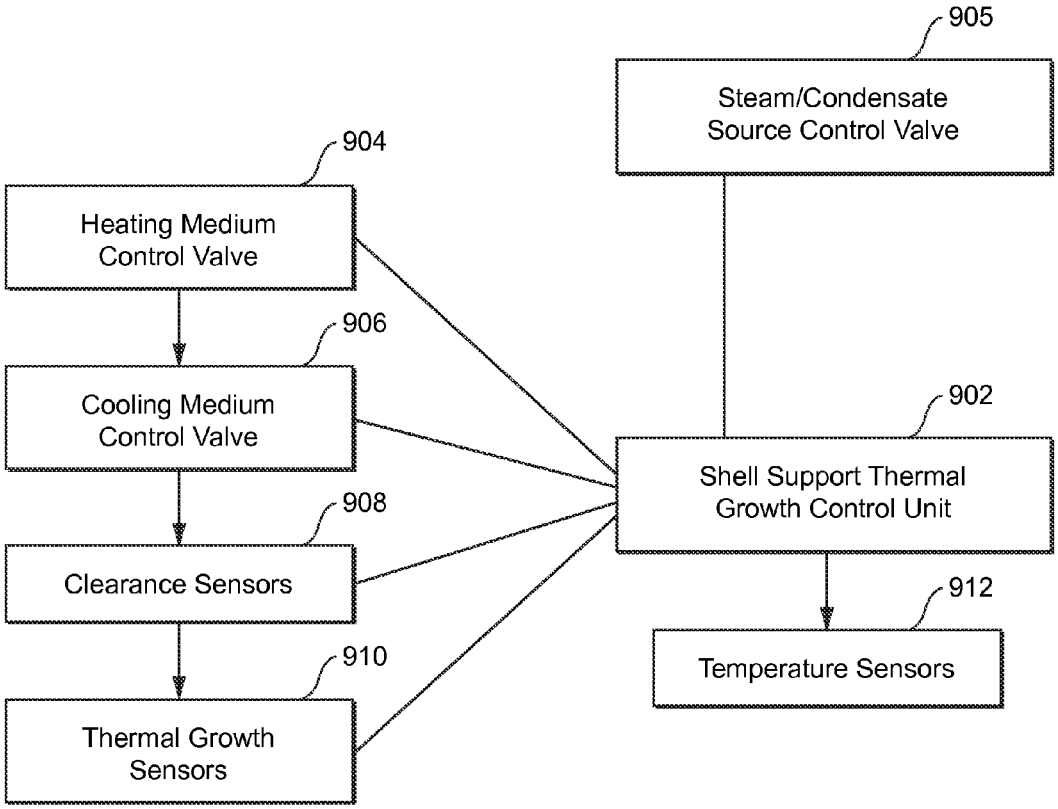
FIG. 9 is a block diagram of elements of a control system that supplies a heating and/or a cooling medium to a steam turbine shell support structure to control thermal expansion or contraction of the shell support structure.

FIG. 9 illustrates elements of an overall system that would be used to control the thermal expansion and contraction of shell support structures 120 during transient periods. As shown therein, the system includes a shell support thermal growth control unit 902 that is operatively coupled to a heating medium control valve 904 and a cooling medium control valve 906.

In some embodiments, the shell support thermal growth control unit 902 would selectively control the heating medium control valve 904 and the cooling medium control valve 906 based on predetermined profiles or schedules to selectively control the flow of heating medium or cooling medium through the internal passageways of the shell support structures 120. This would be done to match the thermal expansion and contraction of the shell support structures 120 to the thermal expansion and contraction of the bearing support structures 140. The predetermined profiles or schedules could be established by experimentation.

In alternate embodiments, the system may include one or more clearance sensors 908 that are operatively coupled to the shell support thermal growth control unit 902. The clearance sensors 908 could sense one or more clearances between elements of the rotor and elements of the stator. Alternatively, the clearance sensors 908 could detect a clearance in one or more bearings of the steam turbine. Signals indicative of the sensed clearance(s) would be provided to the shell support thermal growth control unit 902, and the sensor signals would be used to determine how to control the heating medium control valve 904 and the cooling medium control valve 906 to control the thermal expansion and contraction of the shell support structures 120.

In other embodiments, thermal growth sensors 910 could be provided on the bearing support structures 140 and also possibly on the shell support structures 120. Signals from the thermal growth sensors 910 would indicate the degree or amount of thermal growth of these elements, and/or possibly a rate of change in the thermal growth being experienced by these elements. This information would be used by the shell support thermal growth control unit 902 to control the heating medium control valve 904 and the cooling medium control valve 906 to control the thermal growth or contraction of the shell support structures 120.

In still other embodiments temperature sensors 912 could be provided on the bearing support structures 140 and also possibly on the shell support structures 120. Signals from the temperature sensors 912 would indicate the temperatures of these elements, and/or possibly a rate of change in the temperature being experienced by these elements. This information would be used by the shell support thermal growth control unit 902 to control the heating medium control valve 904 and the cooling medium control valve 906 to control the thermal growth or contraction of the shell support structures 120.

In embodiments where the steam output from two or more steam turbines is used to heat and/or cool a shell support structure 120, the shell support thermal growth control unit 902 could be coupled to a steam source control valve 905 to control the relative amounts of the steam being used from each of the steam sources. The steam source control valve 905 illustrated in FIG. 9 could correspond to the control valve 640 illustrated in FIG. 8

Figure 10:
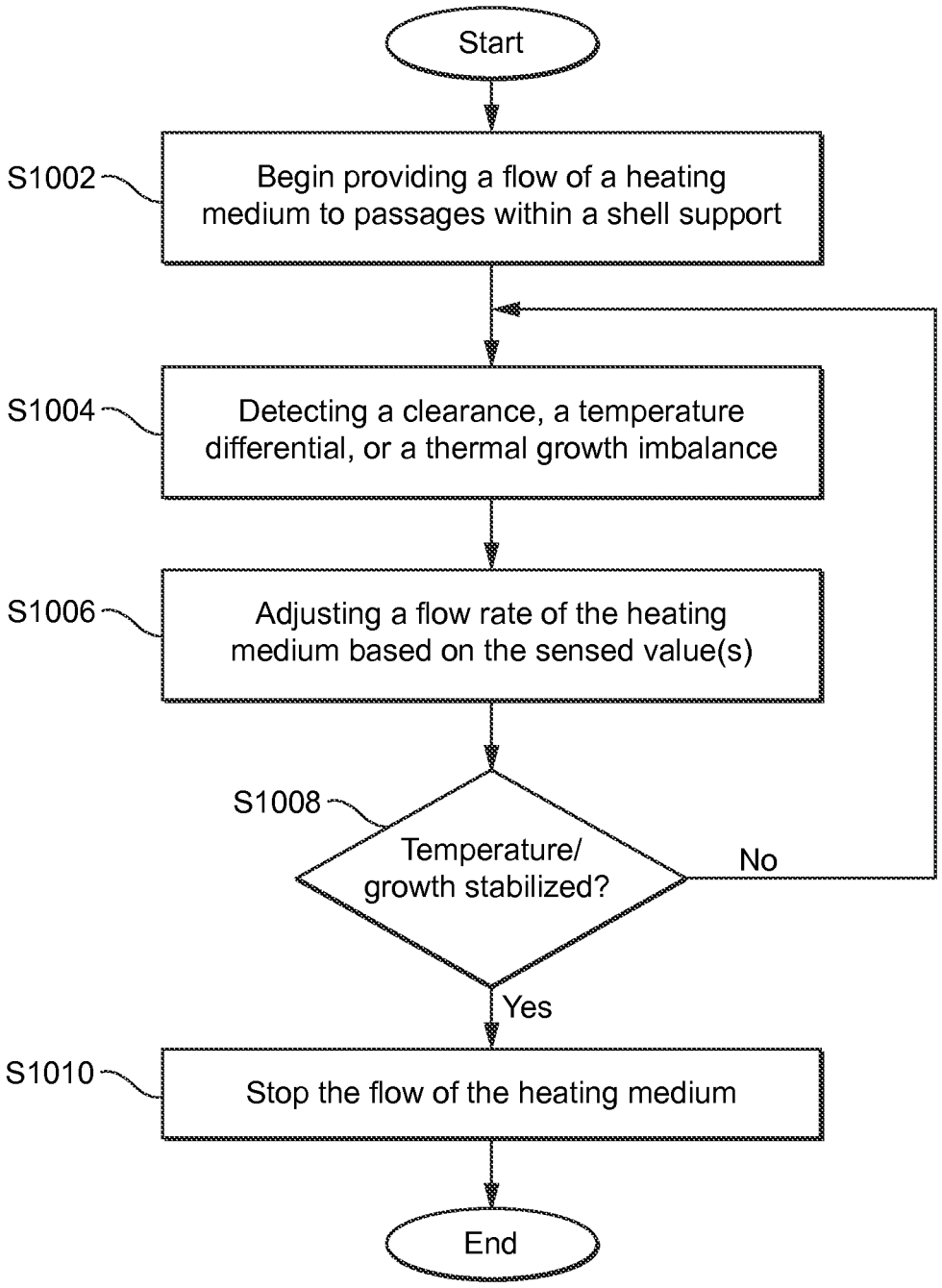
FIG. 10 is a flow diagram illustrating steps of a method of selectively supplying a heating medium to a steam turbine shell support structure to control clearances within the steam turbine.

FIG. 10 illustrates steps of a method of controlling the thermal growth of shell support structures of a steam turbine to maintain desired clearances between the rotor and stator of the steam turbine during a startup operation. The method would make use of systems as illustrated in FIGS. 5-8.

The method begins in step S1002, where the system begins providing a flow of a heating medium to the interior passageway of a shell support structures. Next, in step S1004, a shell support thermal growth control unit would detect one or more of a clearance in the steam turbine, a temperature differential between the shell support structures and the bearing support structures, and a thermal growth differential between the shell support structures and the bearing support structures. This information would be obtained from sensors, as described above.

Next, in step S1006, the flow rate of the heating medium would be selectively controlled, based on the information obtained in step S1004, to control the thermal expansion of the shell support structures so that it approximates the thermal expansion of the bearing support structures. Then, in step S1008, a check is performed to determine if steady state operations have been achieved. This would basically mean checking the information provided by the sensors to determine if the bearing support structures and/or the shell support structures have stopped changing their temperature or stopped expanding. If not, the method loops back to step S1004. If so, the method proceeds to step S1010, and the flow of heating medium into the shell support structures is stopped.

A similar process would be used to control the flow of a cooling fluid into the shell support structures during a shutdown operation to match the thermal contraction of the shell support structures to the thermal contraction of the bearing support structures.

While the invention has been described in connection with what is presently considered to be the most practical and preferred embodiments, it is to be understood that the invention is not to be limited to the disclosed embodiments, but on the contrary, is intended to cover various modifications and equivalent arrangements which are encompassed within the spirit and scope of the appended claims.

What is claimed is:

1. A system for controlling a clearance between a rotor and a stator of a steam turbine during transient operations, comprising:

a shell support structure configured to support a shell of a steam turbine, the shell support structure including:

a main body having a base and an upper support that is configured to support at least one shell arm of the shell of the steam turbine; and an interior passageway that passes through an interior of the main body between an inlet and an outlet, wherein the interior passageway is configured to conduct a flow of a heating or cooling medium;

a medium supply line that is coupled to an inlet of the interior passageway of the shell support structure, the medium supply line supplying condensate that has been created from steam that has passed through the steam turbine; and a control valve that selectively varies a flow rate of the condensate through the interior passageway of the shell support structure.

2. The system of claim 1, wherein the interior passageway comprises:

an inlet manifold operatively coupled to the inlet;

an outlet manifold operatively coupled to the outlet; and a plurality of branches that extend between the inlet manifold and the outlet manifold.

3. The system of claim 1, wherein the interior passageway comprises a serpentine passageway that extends through the main body between the inlet and outlet.

4. The system of claim 1, further comprising:

a cooling medium supply line that is coupled to the inlet of the interior passageway of the shell support structure, the cooling medium supply line supplying a cooling medium to the inlet; and a control valve that selectively varies a flow rate of the cooling medium through the interior passageway of the shell support structure.

5. A method of controlling a clearance between a rotor and a stator of a steam turbine during transient operations, comprising:

determining that transient operations have begun; and selectively supplying a flow of condensate formed from steam that has exited the steam turbine to an interior passageway of a shell support structure of the steam turbine to cause controlled thermal growth of the shell support structure, thereby controlling the clearance between the rotor and the stator of the steam turbine.

6. The method of claim 5, wherein the step of selectively supplying the flow of the condensate comprises:

receiving a clearance signal from a clearance or proximity sensor of the steam turbine; and selectively varying the flow of the condensate based on the clearance signal.

7. The method of claim 6, wherein the received clearance signal is indicative of an amount of clearance between an element coupled to the rotor and an element coupled to the stator.

8. The method of claim 6, wherein the step of receiving the clearance signal comprises receiving the clearance signal from a proximity sensor in a bearing housing of a bearing coupled to the rotor of the steam turbine.

9. The method of claim 5, wherein the step of selectively supplying the flow of the condensate comprises:

receiving signals from thermal growth sensors that are indicative of a degree of thermal growth of the shell support structure and a degree of thermal growth of a bearing support structure of the steam turbine; and selectively varying the flow of the condensate that is supplied to the interior passageway of the shell support structure based on the signals from the thermal growth sensors.

10. The method of claim 9, wherein the flow of the condensate is selectively varied to cause the shell support structure to thermally grow at approximately the same rate as the bearing support structure.

11. The method of claim 5, further comprising:

receiving signals from thermal growth sensors that are indicative of a degree of thermal contraction of the shell support structure and a degree of thermal contraction of a bearing support structure of the steam turbine; and selectively supplying a flow of a cooling medium to the interior passageway of the shell support structure based on the signals from the thermal growth sensors.

12. The method of claim 11, wherein the flow of the cooling medium is selectively varied to cause the shell support structure to thermally contract at approximately the same rate as the bearing support structure.

13. The method of claim 5, wherein the step of selectively supplying the flow of the condensate comprises:

receiving signals from temperature sensors that are indicative of a temperature of the shell support structure and a temperature of a bearing support structure of the steam turbine; and selectively varying the flow of the condensate that is supplied to the interior passageway of the shell support structure based on the signals from the temperature sensors.

14. The method of claim 13, wherein the flow of the condensate is selectively varied to cause the temperature of the shell support structure to approximately match the temperature of the bearing support structure.

15. The method of claim 5, further comprising:

receiving signals from temperature sensors that are indicative of a temperature of the shell support structure and a temperature of a bearing support structure of the steam turbine; and selectively supplying a flow of a coolant into the interior passageway of the shell support structure based on the signals from the temperature sensors.

16. The method of claim 15, wherein the flow of the coolant is selectively varied to cause the temperature of the shell support structure to approximately match the temperature of the bearing support structure.

17. A system for controlling a clearance between a rotor and a stator of a steam turbine during transient operations, comprising:

means for determining that transient operations have begun; and means for selectively supplying a flow of a condensate formed from steam exiting the steam turbine to an interior passageway of a shell support structure of the steam turbine to cause controlled thermal growth of the shell support structure, thereby controlling the clearance between the rotor and the stator of the steam turbine.

18. The system of claim 17, wherein the means for selectively supplying the flow of the condensate comprises:

a condensate supply line that supplies the flow of the condensate; and a condensate control valve operatively coupled to the condensate supply line and which controls a flow rate of condensate that is delivered through the condensate supply line to the interior passageway of the shell support structure.

19. The system of claim 18, further comprising:

a cooling medium supply line coupled to the interior passageway of the shell support structure that supplies a flow of a cooling medium; and a cooling medium control valve operatively coupled to the cooling medium supply line which controls a flow rate of cooling medium that is delivered through the cooling medium supply line to the interior passageway of the shell support structure.

* * * * *